US005340529A

United States Patent [19]

DeWitt et al.

[11] Patent Number: 5,340,529

[45] Date of Patent: Aug. 23, 1994

[54] GOLD JEWELRY ALLOY

[76] Inventors: Troy C. DeWitt; Vicki A. DeWitt, both of 945 Grand Ave., St. Paul, Minn. 55105

[21] Appl. No.: 85,763

[22] Filed: Jul. 1, 1993

[51] Int. Cl.[5] ..... C22C 5/02; C22C 9/00

[52] U.S. Cl. ..... 420/483; 420/497; 420/507; 420/511; 420/587

[58] Field of Search ..... 420/507, 511, 512, 497, 420/587, 483; 148/430, 413, 414, 419, 405, 432, 434, 435

[56] References Cited

U.S. PATENT DOCUMENTS

| | | | |
|---|---|---|---|
| 3,769,006 | 10/1973 | Ingersoll | 75/165 |
| 3,810,755 | 5/1974 | Jordan | 75/165 |
| 4,446,102 | 5/1984 | Bales | 420/507 |
| 5,045,411 | 9/1991 | Taylor et al. | 428/672 |
| 5,173,132 | 12/1992 | Solomon | 148/405 |
| 5,180,551 | 1/1993 | Agarwal | 420/511 |

FOREIGN PATENT DOCUMENTS

| | | | |
|---|---|---|---|
| 59-56545 | 4/1984 | Japan | 420/511 |
| 59-107042 | 6/1984 | Japan | 420/511 |
| 59-157243 | 9/1984 | Japan | 420/511 |
| 0579331 | 11/1977 | U.S.S.R. | 420/511 |

OTHER PUBLICATIONS

McDonald, Allen S. et al., "The Metallurgy of Some Carat Gold Jewelry Alloys; Part I—Colored Gold Alloys," *Gold Bulletin,* Jul. 1978, vol. 11, No. 3.

*Primary Examiner*—Richard O. Dean
*Assistant Examiner*—Sean Vincent
*Attorney, Agent, or Firm*—Nawrocki, Rooney & Sivertson

[57] ABSTRACT

A gold based jewelry alloy is disclosed of preferably the 10 to 18 karat range containing primarily gold, copper, zinc and silver. This alloy is formulated to create a unique color, a mid-range hue with a fresh, soft appearance that is very complimenting to a variety of skin tones and gem stones. Aside from characteristics of appearance, the alloy disclosed has an increased hardness over standard yellow alloys for longer wear and improved polish holding characteristics. The alloy disclosed has excellent castability and formability and responds well to typical jewelry manufacturing processes (i.e., tooling, stone setting, soldering, remelting, forging and plating). The alloy contains about 40% to about 76% gold, about 20% to about 52% copper, about 0% to about 12% zinc and about 0% to about 12% silver.

12 Claims, No Drawings

GOLD JEWELRY ALLOY

FIELD OF THE INVENTION

This invention relates to alloys for use in the manufacture of jewelry, and more particularly, to a gold based alloy containing primarily gold, copper, silver and zinc, generally in the 10 to 18 karat range composed in a formula creating a unique peach or orangish color gold alloy.

BACKGROUND OF THE INVENTION

The basic elements of the gold based alloy of the present invention, primarily gold, copper, zinc and silver are well known and frequently used in the jewelry industry. This invention uses these elements (other than the gold component for standard karat contents, 10–18K) in amounts and ratios believed undisclosed in the art to create a gold alloy with an entirely new color and character. In examination of the known prior art, what is found reveals no attempts to create a gold jewelry alloy of a very unusual, and separate color, having an improved aesthetic relationship between typical skin tones and jewelry related materials such as gemstones.

Prior work has mainly shown improvements on existing "standard" colors as it would relate to specific metallurgic properties, or the maintenance of standard colored alloys while lowering or altering gold content for an economic advantage.

Other prior art alloys have disclosed ideas that relate to very broad ranges of gold content, but formulate very small amounts of a variety of elements that perhaps create a characteristic (reversible hardness, a spring effect, or deoxidant, etc.) that is generally applicable only to a very small segment of jewelry manufacturing. This invention targets a specific karat span, and a relatively small variable range for the acceptable formula.

Standard colors of gold known to the manufacturing of jewelry are yellow, white, green and rose or pink and are generally alloyed to form a 10 karat to 18 karat gold product. The jewelry industry as a whole is believed lacking an alloy of any kind that has a complimenting color to the skin tones it is typically worn against. From an aesthetic point of view, the problems prior art metals have had are the yellows were very cool tones, while the pink or rose alloys were very warm tones, offering only metals of high contrast to most skin tones. The present invention addresses this problem with an alloy that is very much a mid-tone in terms of color and "temperature" but still maintains the important metallurgic characteristics of known quality karat golds, e.g., high degree of lustre and shine, tarnish and corrosion resistance, resistance to cracking, surface smoothness and very good wear and durability properties.

Other requirements for an alloy to be practically utilized in the jewelry industry are that it can readily be cast, soldered or cold worked, such as forging and rolling. Preferable metallurgic and physical properties for a gold jewelry alloy include a moderate level of hardness to extend the jewelry pieces wear and polish life without adversely affecting malleability and ductility. Hardness is also a concern in the area of surface finishing jewelry, i.e., sawing, shearing, filing, tumbling, sanding, and polishing. A high level of malleability and ductility becomes important to an alloy when the manufacturing process includes forging and/or machine forming, or is required to be made into various forms of sheet and wire. A jewelry alloy should also have a level of fluidity that allows smooth, detailed castings. The goods made from the alloy, whether cast or formed should be easily joinable with solders. An ideal alloy would have these properties as well as having excellent memory (ability to hold form) and annealability (a resoftening process using heat).

SUMMARY OF THE INVENTION

A very unique peach or orangish color gold alloy for jewelry is created by the invention. Another object of the present invention is an alloy that has an improved aesthetic and complimentary relationship towards many skin tones and gem stones. It provides for an unusual middle tone, middle temperature (visually) alloy unlike the cool tones of a yellow gold alloy or warm tones of a rose or pink gold alloy.

The main constituents are known elements in the jewelry industry formulated in very unusual amounts and ratios. It is believed there is no prior art in this area of unique colored, copper based gold alloys. The main constituents are familiar elements which allows the production of the alloy through finished jewelry manufacturing with conventional techniques and equipment.

The alloy has an increased hardness over standard yellow alloys for extended wear and polish holding properties, yet remains malleable. The alloy maintains an excellent level of castability and formability and polishes to a very lustrous, smooth and durable finish. This alloy and its characteristics may be obtained by the following composition by weight:

| | |
|---|---|
| Gold: | about 40% to about 76% |
| Copper: | about 20% to about 52% |
| Zinc: | about 1% to about 6% |
| Silver: | about 1% to about 6% |

Optional elements which may be present in the alloy by weight are: palladium up to about 3%, platinum up to about 3%, cadmium up to about 12%, lead up to 2.5%, aluminum up to about 3%, iron up to about 2%, nickel up to about 4%, silicon up to about 1%, boron up to about 1%, indium up to about 2%, phosphorous up to about 0.25%.

A presently acceptable general range of percentages of the alloy by weight is as follows:

| | General Range | | |
|---|---|---|---|
| | 10K | 14K | 18K |
| Gold | 41.67–41.67% | 58.33–58.33% | 75.0–75.0% |
| Copper | 47.0–52.0% | 33.5–37.5% | 20.0–22.3% |
| Zinc | 6.1–2.7% | 4.3–1.5% | 2.5–1.1% |
| Silver | 5.4–3.7% | 3.8–2.4% | 2.3–1.5% |

A preferred acceptable range of percentages of the alloy by weight is as follows:

| | Preferred Range | | |
|---|---|---|---|
| | 10K | 14K | 18K |
| Gold | 41.67–41.67% | 58.33–58.33% | 75.0–75.0% |
| Copper | 49.5–50.1% | 35.0–35.3% | 21.16–21.42% |
| Zinc | 4.4–3.9% | 3.2–2.9% | 1.94–1.83% |
| Silver | 4.5–4.3% | 3.3–3.1% | 1.86–1.68% |

Remaining percentages consist of trace amounts of silicon, nickel, indium, magnesium and iron.

These and various other advantages and features of novelty which characterize the present invention are pointed out with particularlity in the claims annexed hereto and forming a part hereof. However, for a better understanding of the invention, its advantages, and the object obtained by its use, reference should be made to the accompanying descriptive matter in which there are illustrated and described preferred embodiments of the present invention.

DETAILED DESCRIPTION OF THE INVENTION

Detailed embodiments of the present invention are disclosed herein. However, it is to be understood that the disclosed embodiments are merely exemplary of the present invention which may be embodied in various systems. Therefore, specific details disclosed herein are not to be interpreted as limiting, but rather as a basis for the claims and as a representative basis for teaching one of skill in the art to variously practice the invention.

The gold alloy of the present invention is best characterized by its unmistakable peachish or orange coloration. The alloy is visually easily distinguished between other known standard colors, being yellow gold, white gold, green gold and rose or pink gold alloys. The present alloy is more closely compatible with a wider range of skin tones than any of the above "standards."

It is not the intention of the invention to match any particular skin tonality but to reduce total contrast, while offering a new color that has important aesthetic qualities in and of itself. In general, the perception of the alloy is one of a very soft and warm feel as compared to a yellow gold or green gold alloy, yet being much fresher and cooler in color and hue than a rose or pink gold alloy.

The alloy exhibits an excellent level of wearability and can be formed into usual manufacturing stocks such as casting grains, rolled goods such as sheet and wire, and with the addition of cadmium of up to 12%, a solder to match the present invention may be made. Known and usual methods and processes for the casting, fabrication and finishing of jewelry are effective with this alloy.

The constituents melt and create a homogenous mixture easily and within usual melt temperatures of other gold alloys. The preferred metallurgical qualities and preferred qualities are achieved within a relatively narrow composition range. The constituents by weight are:

| | Range |
|---|---|
| Gold: | about 40% to about 76% |
| Copper: | about 20% to about 52% |
| Zinc: | about 1% to about 6% |
| Silver: | about 1% to about 6% |

This composition is based on the use of pure metals (99.9% or better) the alloy is made in a standard crucible melt (gas or electric) and may be fluxed with usual industry flux formulas and technique.

When the melt has evenly mixed, in its molten state, it may be cast into articles of jewelry by the use of either vacuum casting equipment or centrifugal equipment. Usual cooling times and quenching techniques are used to recover castings. A prepared melt in its molten stage, homogeneously mixed, may also be poured into ingots, bars, or grain later to be used as a stock to create rolled sheet, dimensional wires, round wire, solders and castings for the manufacture of jewelry.

Depending upon the exact intended use of the alloy, it may contain lesser amounts of optional elements. Silicon may be included up to about 1%. Silicon acts as a deoxidizer and works especially well in casting but is not recommended for rolling or drawing wire since the silicon may cause cracking when the alloy is worked at room temperature. The addition of phosphorus of up to about 0.25% as a deoxidizer is known in the art to minimize cracking of the alloy during rolling, wire drawing or cold working. Indium may be added up to about 2%, and/or boron, up to about 1% to increase flow properties important to intricate casting. Nickel up to about 4% hardens the alloy and its resistance to corrosion without impairing ductility. Iron up to about 2% can be employed as a color stabilizer but in larger amounts degenerates tarnish resistiveness. Aluminum may be present up to about 3% as a deoxidation agent but can cause brittleness.

To lower melting temperature, lead may be used up to about 2.5%. The present invention may have cadmium added in an amount up to about 12% to produce a solder for the alloy. For tarnish resistance palladium up to about 3% or platinum up to about 3% may be mixed with the alloy.

A preferred combination of optional elements recommended for a casting grain would contain about 0.1% to 0.5% silicon to deoxidize the castings, and indium from about 0.2% to 0.8% to improve fluidity while casting. A preferred addition to produce a produce a product that will respond well to cold working, rolling and drawing of wire is phosphorus in an amount of about 0.05% to 0.15%.

In describing the present invention, it is noted that a key factor in the formulation of the color of the alloy is the percentage relationship by weight between pure gold (a yellow metal), copper (a red metal), and zinc and silver (a white metal). Other white metals may be substituted for the zinc and silver content in an attempt to create the present invention through a varied formula. However, most provide short comings found in either color, metallurgic properties, or both.

It is believed acceptable results can be obtained by substituting the white metal portion of the formula (silver and zinc) with nickel, palladium and indium in part, in combination, or wholly when within the disclosed range of the composition. Though a more narrowly useable range of characteristics generally results these three optional elements may be used: nickel 0% to 12% palladium 0% to 12% and indium 0% to 12% but not to exceed disclosed formula total percentages for silver and zinc.

A presently acceptable general range of percentages by weight in terms of commonly used karats, is as follows:

| | General Range | | |
|---|---|---|---|
| | 10K | 14K | 18K |
| Gold | 41.67–41.67% | 58.33–58.33% | 75.0–75.0% |
| Copper | 47.0–52.0% | 33.5–37.5% | 20.0–22.3% |
| Zinc | 6.1–2.7% | 4.3–1.5% | 2.5–1.1% |
| Silver | 5.4–3.7% | 3.8–2.4% | 2.3–1.5% |

A most preferred composition of the alloy by weight in terms of commonly used karats, is as follows:

| | Preferred Range | | |
|---|---|---|---|
| | 10K | 14K | 18K |
| Gold | 41.67–41.67% | 58.33–58.33% | 75.0–75.0% |
| Copper | 49.5–50.1% | 35.0–35.3% | 21.16–21.42% |
| Zinc | 4.4–3.9% | 3.2–2.9% | 1.94–1.83% |
| Silver | 4.5–4.3% | 3.3–3.1% | 1.86–1.68% |

Remaining percentages consist of trace amounts of silicon, nickel, indium, and iron.

Currently, the most preferred composition to produce the invention in its most commonly used karats is as follows: 10 karat contains 41.67% gold, 49.67% copper, 4.41% silver, and 4.12% zinc. A 14 karat alloy contains 58.33% gold, 35.26% copper, 3.22% silver, and 3.1% zinc. An 18 karat alloy contains 75.0% gold, 21.28% copper, 1.89% silver and 1.76% zinc.

The optional and trace elements discussed thus far are elements known to the art of alloy development and jewelry manufacturing. The body of these percentages and descriptions are made known with this invention as a means to tune an already well engineered alloy. The main constituents of the invention alloy stand well on their own merits.

Copper is the largest percentage constituent in the alloy (aside from gold). It has a relatively high melting temperature but has good malleability and ductility and tensile strength second only to iron. Copper also works to harden the alloy and provide the red component of the color formula. The zinc content in this invention is important to lower melting temperatures, act as a deoxidizer, harden the alloy, and participate as a whitener in composing alloy color. Zinc, however, does not display a high degree of malleability or ductility. The alloy's silver content is close to that of zinc and is the other participant in the whitening percentage of the alloy to form color. Silver is also chosen for its effect on malleability.

These three constituents alloyed within the general and preferred guidelines of this invention as described, and, additionally alloyed with gold (having superior qualities of malleability and ductility) will produce the present invention.

New characteristics and advantages of the invention covered by this document have been set forth in the foregoing description. It will be understood, however, that this disclosure is, in many respects, only illustrative. Changes may be made in details, particularly in matters of shape, size, and arrangement of parts, without exceeding the scope of the invention. The scope of the invention is, of course, defined in the language in which the appended claims are expressed.

What is claimed is:

1. A 10 karat gold jewelry alloy comprising:
(a) 40 weight % to 42 weight % gold;
(b) 47 weight % to 52 weight % copper; and
(c) 6.4 weight % to 11.5 weight % of a white metal selected from the group consisting of zinc, silver, indium and mixtures thereof.

2. The alloy of claim 1, further comprising about 0.1 weight % to about 0.5 weight % silicon.

3. The alloy of claim 1, further comprising about 0.05 weight % to about 0.15 weight % phosphorous.

4. The alloy of claim 1, further comprising about 2 weight % to about 9 weight % cadmium.

5. An 18 karat gold jewelry alloy comprising:
(a) 74 weight % to 76 weight % gold;
(b) 20 weight % to 22.3 weight % copper; and
(c) 2.6 weight % to 4.8 weight % of a white metal selected from the group consisting of zinc, silver, indium and mixtures thereof.

6. The alloy of claim 5, further comprising about 0.1 weight % to about 0.5 weight % silicon.

7. The alloy of claim 6, further comprising 0.05 weight % to about 0.15 weight % phosphorous.

8. The alloy of claim 7, further comprising about 2 weight % to about 9 weight % cadmium.

9. A 14 karat gold alloy comprising:
(a) 57 weight % to 59 weight % gold;
(b) 35 weight % to 37.5 weight % copper; and
(c) 3.9 weight % to 7.0 weight % of a white metal, said white metal selected from the group consisting of silver, zinc, indium and mixtures thereof.

10. The alloy of claim 9, further comprising about 0.1 weight % to about 0.5 weight % silicon.

11. The alloy of claim 9, further comprising about 0.05 weight % to about 0.15 weight % phosphorous.

12. The alloy of claim 9, further comprising about 2 weight % to about 9 weight % cadmium.

* * * * *